US008212759B2

(12) United States Patent
Luo et al.

(10) Patent No.: US 8,212,759 B2
(45) Date of Patent: Jul. 3, 2012

(54) CONTROL CIRCUIT AND CONTROL METHOD FOR LCD PANEL

(75) Inventors: Hsin Chung Luo, Lu Kang Town (TW); Dong Sen Fang, Hsin Chu (TW); Ho Hsing Yang, Hsin Chu (TW)

(73) Assignee: Sunplus Technology, Co., Ltd., Hsin-Chu (TW)

( * ) Notice: Subject to any disclaimer, the term of this patent is extended or adjusted under 35 U.S.C. 154(b) by 1392 days.

(21) Appl. No.: 11/338,677

(22) Filed: Jan. 25, 2006

(65) Prior Publication Data

US 2006/0262065 A1 Nov. 23, 2006

(30) Foreign Application Priority Data

May 23, 2005 (TW) ..... 94116630 A

(51) Int. Cl.
*G09G 3/36* (2006.01)

(52) U.S. Cl. ..... 345/100; 345/89; 345/99; 345/204; 345/213

(58) Field of Classification Search ..... 345/98, 345/87, 99, 100, 213, 89, 204
See application file for complete search history.

(56) References Cited

U.S. PATENT DOCUMENTS

| | | | | |
|---|---|---|---|---|
| 5,170,158 | A * | 12/1992 | Shinya | 345/98 |
| 5,764,212 | A * | 6/1998 | Nishitani et al. | 345/98 |
| 6,229,513 | B1 * | 5/2001 | Nakano et al. | 345/99 |
| 6,784,861 | B2 * | 8/2004 | Okada | 345/87 |
| 2003/0146896 | A1 * | 8/2003 | Sekine | 345/98 |
| 2004/0263462 | A1 * | 12/2004 | Igarashi | 345/98 |

* cited by examiner

*Primary Examiner* — Lun-Yi Lao
*Assistant Examiner* — Shaheda Abdin
(74) *Attorney, Agent, or Firm* — Muncy, Geissler, Olds & Lowe, PLLC

(57) ABSTRACT

A timing controller for an LCD panel includes a signal receiver, a data reader, a signal receiver, a logic control unit, and a data conversion unit. The signal receiver receives transmitted signals, and the data reader acquires data from the signal receiver. The logic control unit receives the data acquired by the data reader to generate pixel data, and the data conversion unit receives the pixel data and converts them into serial signals. The timing controller converts the pixel data and the control commands into serial signals, and then they are transmitted in serial to each of the source driver chips.

12 Claims, 8 Drawing Sheets

CONTROL CIRCUIT AND CONTROL METHOD FOR LCD PANEL

This application claims the benefit of the filing date of Taiwan Application Ser. No. 094116630, filed on May 23, 2005, the content of which is incorporated herein by reference.

BACKGROUND OF THE INVENTION

1. Field of the Invention

The invention relates to a timing controller and a source driver for a liquid crystal display (LCD) panel, particularly to a timing controller, a source driver, and a control circuit and method for an LCD panel using serial data transmission.

2. Description of the Related Art

In the past years, extensive efforts have been made by notebook designers and manufactures to extend battery life and reduce overall cost of a notebook. Concerning with the signal transmission between a motherboard and a thin-film transistor liquid crystal display (TFT-LCD) panel in a notebook, since it must conform to the existing signal transmission specification, the low-voltage differential signaling (LVDS), there is no room to do the improvement relating the battery life extension and cost reduction.

On the other hand, concerning with the signal transmission between the timing controller and the source driver, it is critical to suppress electromagnetic interference (EMI), and thus differential transmission such as reduced swing differential signaling (RSDS) is widely used in mainstream products. However, as far as the RSDS architecture is concerned, the requirement of RSDS architecture as to a low operating voltage such as lower than 2.3V is often hard to meet. Further, a current-mode differential pair is often selected as the transmission interface of the RSDS architecture to result in considerable power consumption.

FIG. 1 shows a schematic diagram illustrating the connection of a conventional timing controller and multiple source driver chips. Referring to FIG. 1, the timing controller 11 outputs control signals and data streams to each of the source driver chips 120-129, and the signal lines and data bus are connected in parallel between separate source driver chips. Further, since the connection between the timing controller and each source driver chip is achieved by twenty-three lines, including eighteen data lines and five control lines, the panel layout is complicated and the requirement of layout is up to four layers of interconnection, thus unfavorable for reducing manufacture cost and power consumption.

BRIEF SUMMARY OF THE INVENTION

Hence, an object of the invention is to provide a timing controller, a source driver, and a control circuit and method for an LCD panel using serial data transmission to avoid the above-mentioned problems.

According to the invention, a timing controller is used for receiving transmitted signals including control signals and pixel data and converting the control signals and pixel data into serial signals that are transmitted to a plurality of source driver chips. The timing controller includes a signal receiver, a data reader, a logic control unit, and a data conversion unit. The signal receiver receives the transmitted signals, and the data reader acquires data from the signal receiver. The logic control unit receives the data acquired by the data reader to generate the pixel data, and the data conversion unit receives the pixel data and converts them into serial signals.

Through the design of the invention, the timing controller converts the pixel data and the control commands into serial signals, which are transmitted in serial to each of the source driver chips. Since all data are previously converted into serial signals, the communication between the timing controller and each source driver chip is achieved by only three data lines (R, G, and B), a system clock, and a mode control signal. Hence, the PCB layout is simplified to greatly reduce the cost of manufacture and power consumption.

DETAILED DESCRIPTION OF THE INVENTION

The timing controller and the source driver chip for an LCD panel of the invention will be described with reference to the accompanying drawings.

Figure 1:
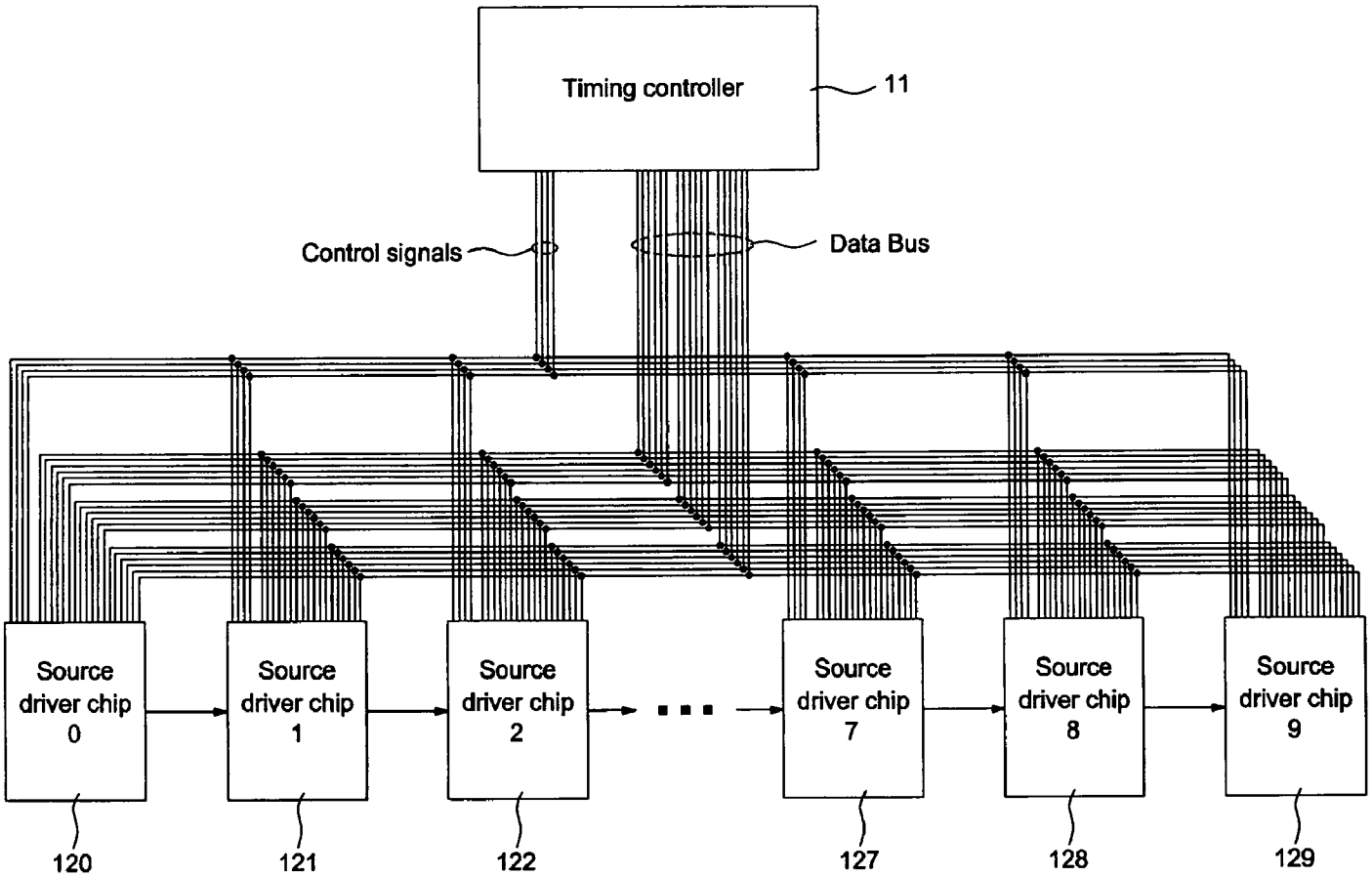
FIG. 1 (PRIOR ART)
FIG. 1 shows a schematic diagram illustrating the connection of a conventional timing controller and multiple source driver chips.
Figure 2:
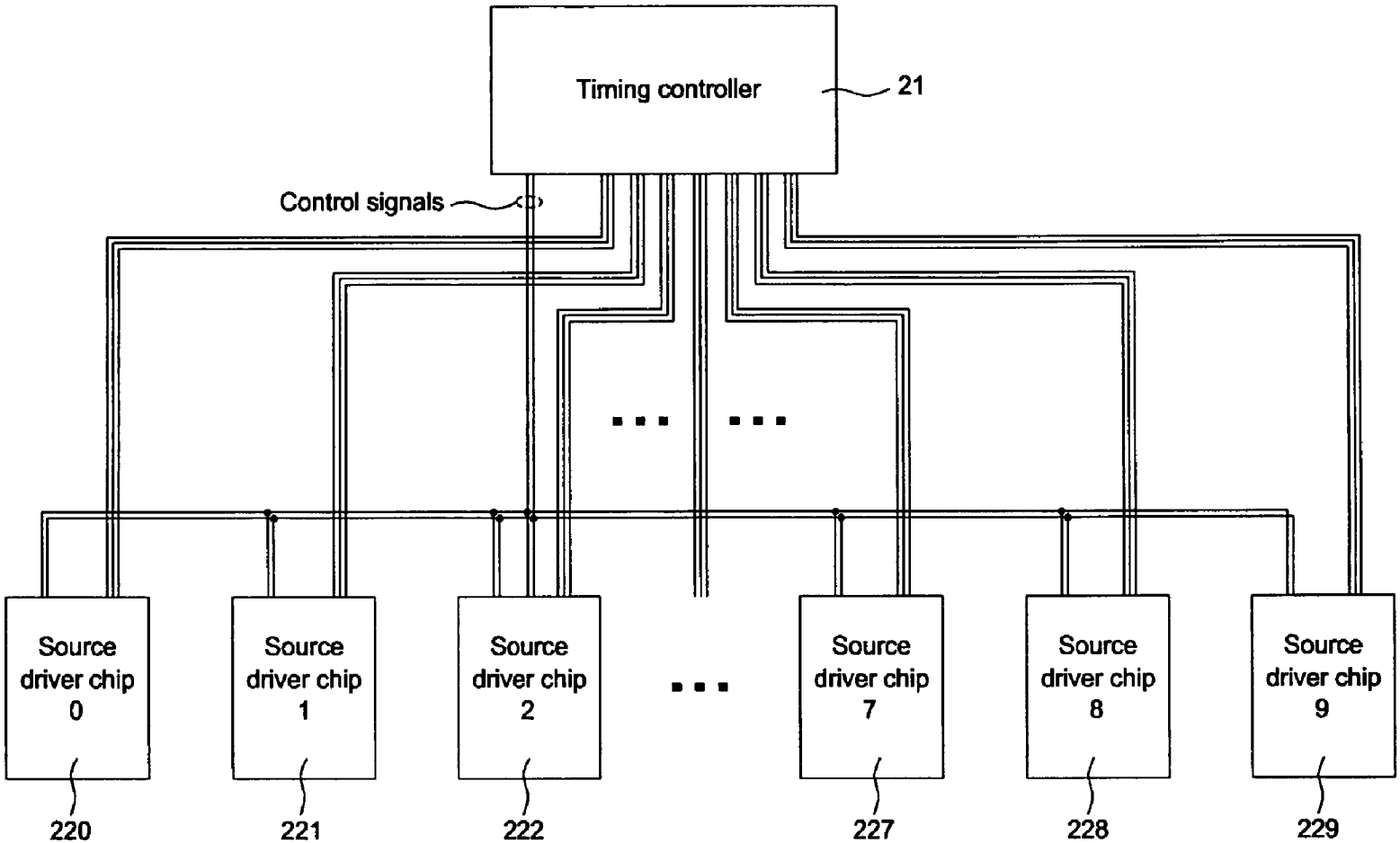
FIG. 2 shows a schematic diagram illustrating the connection of a timing controller and multiple source driver chips according to the invention.

FIG. 2 shows a schematic diagram illustrating the connection of a timing controller and multiple source driver chips according to the invention. Referring to FIG. 2, the data bus for the timing controller 21 are allocated in serial rather than in parallel, and thus only two control signal lines and three data signal lines are needed to connect the timing controller 21 with each of the source driver chips 220-229. Accordingly, the considerable reduction in the number of connection lines greatly decreases the complexity of PCB layout, with the four layers of interconnection cut down to two, so that the manufacture cost and power consumption are reduced and the electromagnetic interference is suppressed. Further, the invented architecture may also be applied to a chip on glass (COG) package on a large-scale panel, and, in that case, a timing controller chip outputs signals to ten source driver chips at a time. Though the number of overall output signal lines of the timing controller is increased to thirty-two, the number of the output signal lines connected to one source driver chip is only five to greatly reduce the complexity of PCB layout. Certainly, the number of the source driver chips is not limited and may be selected according to the channels of the source driver chips and the panel resolution.

Figure 3:
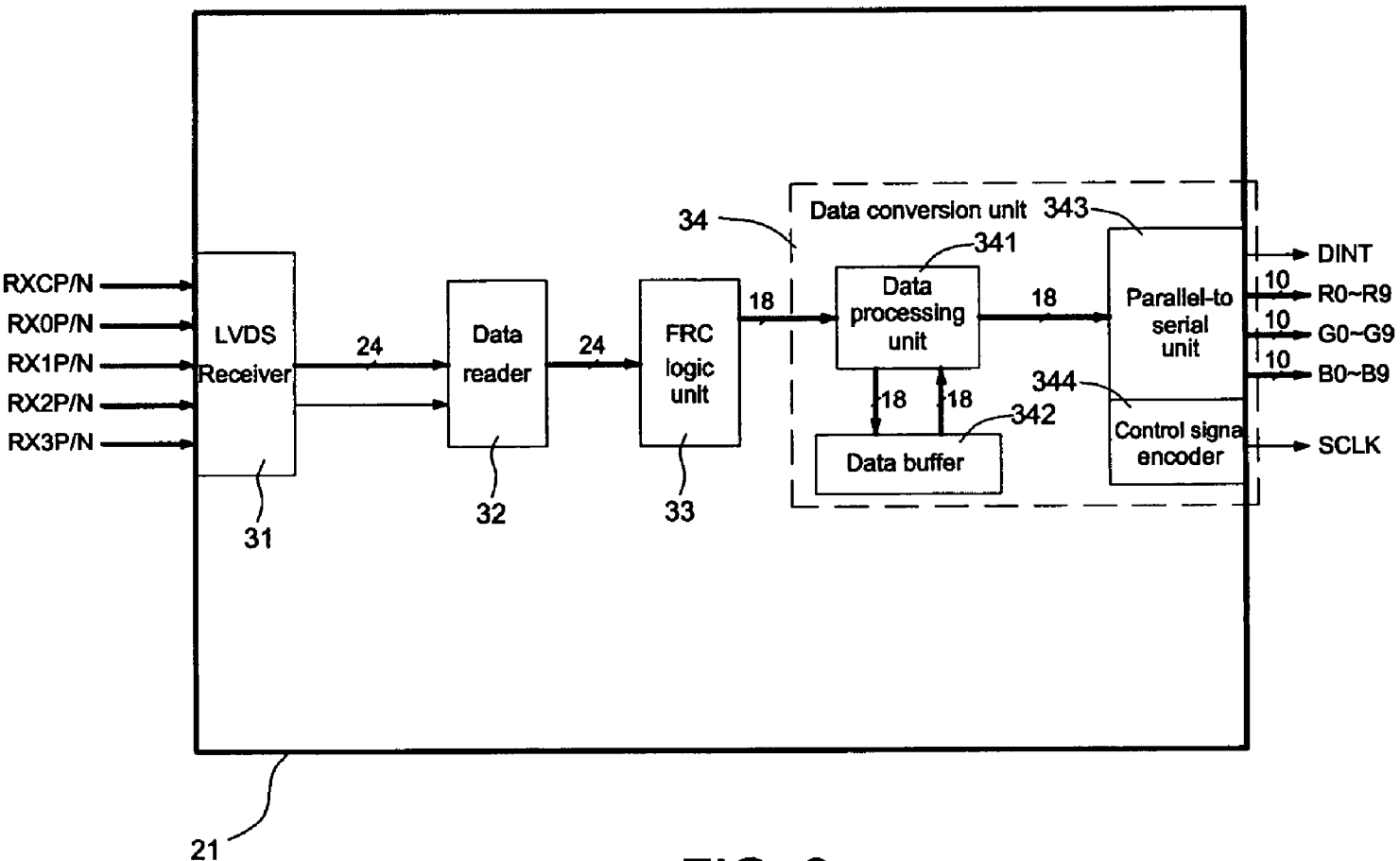
FIG. 3 shows a block diagram illustrating the architecture of a timing controller according to the invention.

FIG. 3 shows a block diagram illustrating the architecture of a timing controller according to the invention. Referring to FIG. 3, the timing controller 21 includes a low-voltage differential signaling (LVDS) receiver 31, a data reader 32, a frame rate control (FRC) logic unit 33, and a data conversion unit 34. In the timing controller 21, the LVDS receiver 31, the data reader 32, and the FRC logic unit 33 are similar to those in a conventional timing controller, thus not explain in detail.

The difference of the timing controller 21 of the invention compared with a conventional timing controller is that the data conversion unit 34 converts the pixel data and control signals into serial signals and transmits them into each of the source driver chips 220-229.

The timing controller 21 outputs signals to each of the source driver chips, and the signals include a mode control signal DINT, a clock signal SCLK, and three data lines R, G, and B. The mode control signal DINT is used to indicate two respective transmission states of the data lines R, G, and B. Specifically, the data lines R, G, and B may transmit typical pixel data (in a data mode) or transmit control commands (in a command mode). When the mode control signal DINT is in a first state (state 1), it indicates the transmission state of the data lines is in a command mode for transmitting control commands. To the contrary, when the mode control signal DINT is in a second state (state 0), it indicates the transmission state of the data lines is in a data mode for transmitting pixel data. The mode control signal DINT is used as a control signal to enable the data lines to switch between the data mode and the command mode.

The command mode, being exclusive to the data mode, often executes before or after the transmission of column data to not affect normal data transmission. Certainly, the command mode may also be applied in initial function settings of the source driver or other function settings in data transmission. Further, the mode control signal DINT, basing on the transmission and control methods for a conventional source driver, is generated by an internal state machine (not shown) that triggers a proper control signal to select the data mode or the command mode according to time sequences of the initialization of each frame and time sequences of each column data transmission. Also, the clock signal SCLK is used to synchronize output data with the source driver chips.

Since the pixel data are transmitted in parallel to each of the source driver chips in a conventional timing controller, the FRC logic unit 33 transmits data to each of the source driver chips in a sequence where a subsequent source driver chip does not receive data until an antecedent source driver chip completes its data reception. To the contrary, the timing controller 21 of the invention outputs data to all source driver chips simultaneously by respective signal lines, and thus the data output by the FRC logic unit 33 must be pre-converted.

The data conversion unit 34 includes a data processing unit 341, a data buffer 342, and a parallel-to-serial converter 343. The data processing unit 341 receives the data output from the FRC logic unit 33 and stores them in the data buffer 342. Then, the data processing unit 341 acquires required data from the data buffer and outputs them to the parallel-to-serial converter 343. Finally, the parallel-to-serial converter 343 transmits the data to each of the source driver chips by respective signal lines. Certainly, the data conversion unit 34 may further include a control signal encoder 344, which encodes control signals that are to be transmitted to each of the source driver chips via the parallel-to-serial converter 343.

Figure 4:
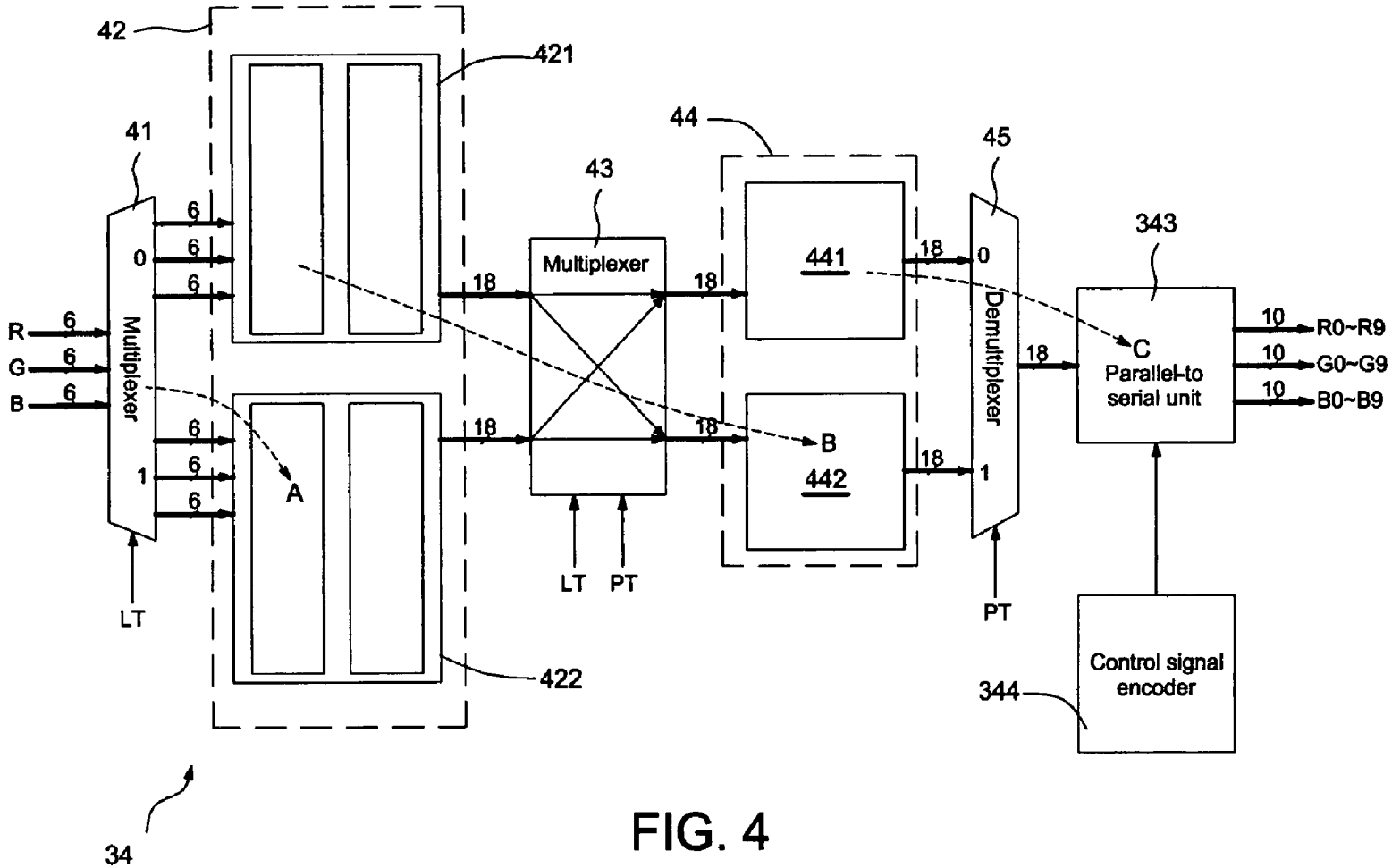
FIG. 4 shows a schematic diagram illustrating the architecture of the data conversion unit shown in FIG. 3.

FIG. 4 shows a schematic diagram illustrating the architecture of the data conversion unit 34 shown in FIG. 3. Referring to FIG. 4, the data conversion unit 34 includes a first multiplexer 41, a memory 42, a second multiplexer 43, a buffer 44, a demultiplexer 45, a parallel-to-serial converter 343, and a control signal encoder 344. The memory 42 includes a first memory segment 421 and a second memory segment 422, and the buffer 44 includes a first buffer section 441 and a second buffer section 442. The data (including R, G, and B pixel data) transmitted from the FRC logic unit 33 are stored in the first memory segment 421 or the second memory segment 422 through the control of the first multiplexer 41 that is controlled by a line switch signal LT. Then, the data stored in the memory segment are further stored in the first buffer section 441 or the second buffer section 442 through the control of the second multiplexer 43. The second multiplexer 43 is controlled by a line switch signal LT and a point switch signal PT. The line switch signal LT controls the data reading from the first memory segment 421 or second memory segment 422, while the point switch signal PT controls the data writing to the first buffer section 441 or the second buffer section 442. Then, the data in the first buffer section 441 or the second buffer section 442 are read out and transmitted to the parallel-to-serial converter 343 through the control of the demultiplexer 45. The demultiplexer 45 is controlled by the point switch signal PT.

Hence, according to state transitions of the line switch signal LT and the point switch signal PT, the data transmission for the data conversion unit 34 may follow one of the four possible paths as described below.

Path 1: when the line switch signal LT is in a first state (such as state 1) and the point switch signal PT is also in a first state (such as state 0), the data (including R, G, and B pixel data) transmitted from the FRC logic unit 33 are stored in the second memory segment 422 through the control of the first multiplexer 41, and the data in the first memory segment 421 are stored in the second buffer section 442 through the control of the second multiplexer 43. Further, the data in the first buffer section 441 are transmitted to the parallel-to-serial converter 343 through the control of the demultiplexer 45, as indicated in dash lines with arrows shown in FIG. 4.

Path 2: when the line switch signal LT is in a first state (such as state 1) and the point switch signal PT is in a second state (such as state 1), the data (including R, G, and B pixel data) transmitted from the FRC logic unit 33 are stored in the second memory segment 422 through the control of the first multiplexer 41, and the data in the first memory segment 421 are stored in the first buffer section 441 through the control of the second multiplexer 43. Further, the data in the second buffer section 442 are transmitted to the parallel-to-serial converter 343 through the control of the demultiplexer 45.

Path 3: when the line switch signal LT is in a second state (such as state 0) and the point switch signal PT is in a first state (such as state 0), the data (including R, G, and B pixel data) transmitted from the FRC logic unit 33 are stored in the first memory segment 421 through the control of the first multiplexer 41, and the data in the second memory segment 422 are stored in the second buffer section 442 through the control of the second multiplexer 43. Further, the data in the first buffer section 441 are transmitted to the parallel-to-serial converter 343 through the control of the demultiplexer 45.

Path 4: when the line switch signal LT is in a second state (such as state 0) and the point switch signal PT is also in a second state (such as state 1), the data (including R, G, and B pixel data) transmitted from the FRC logic unit 33 are stored in the first memory segment 421 through the control of the first multiplexer 41, and the data in the second memory segment 422 are stored in the first buffer section 441 through the control of the second multiplexer 43. Further, the data in the second buffer section 442 are transmitted to the parallel-to-serial converter 343 through the control of the demultiplexer 45.

Figure 5:
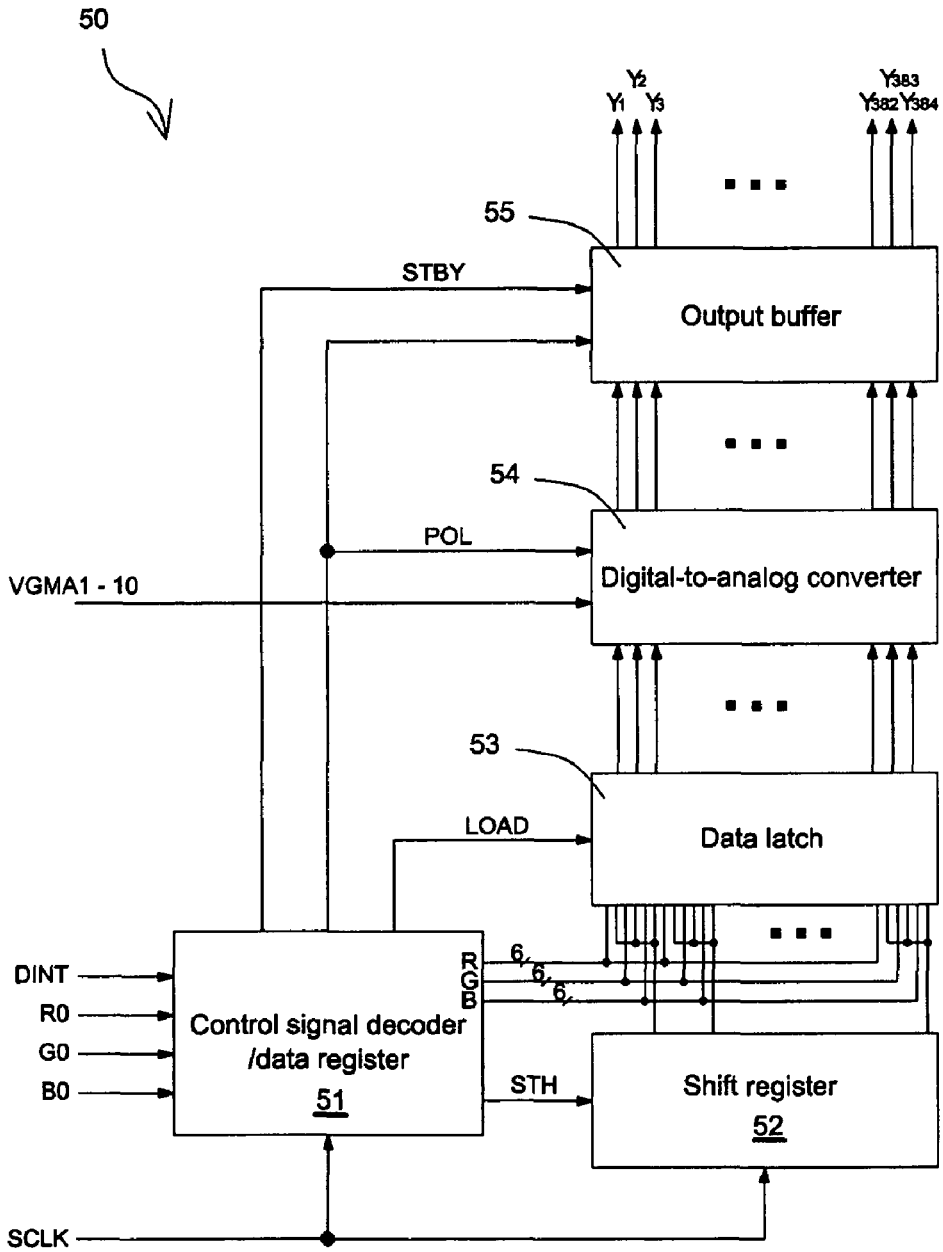
FIG. 5 shows a schematic diagram illustrating the architecture of a source driver of the invention.

FIG. 5 shows a schematic diagram illustrating the architecture of a source driver of the invention. Referring to FIG. 5, the source driver 50 includes a control signal decoder/data register 51, a shift register 52, a data latch 53, a digital-to-analog converter 54, and an output buffer 55. The shift register 52, data latch 53, digital-to-analog converter 54, and output buffer 55 are well known in the art, thus not explaining in detail.

The control signal decoder/data register 51 receives the mode control signal DINT, the clock signal SCLK, and three data lines R, G, and B. The control signal decoder/data register 51 either generates required control signals or receives pixel data according to the state of the mode control signal DINT. A typical conventional control signal may be a shift control signal STH to control the shift register 52, a load control signal LOAD to control the data latch 53, a polarity control signal POL to control the digital-to-analog converter 54, or a standby control signal STBY to control the output buffer 55. The control methods for these signals are well known in the art, thus not explaining in detail.

Figure 6:
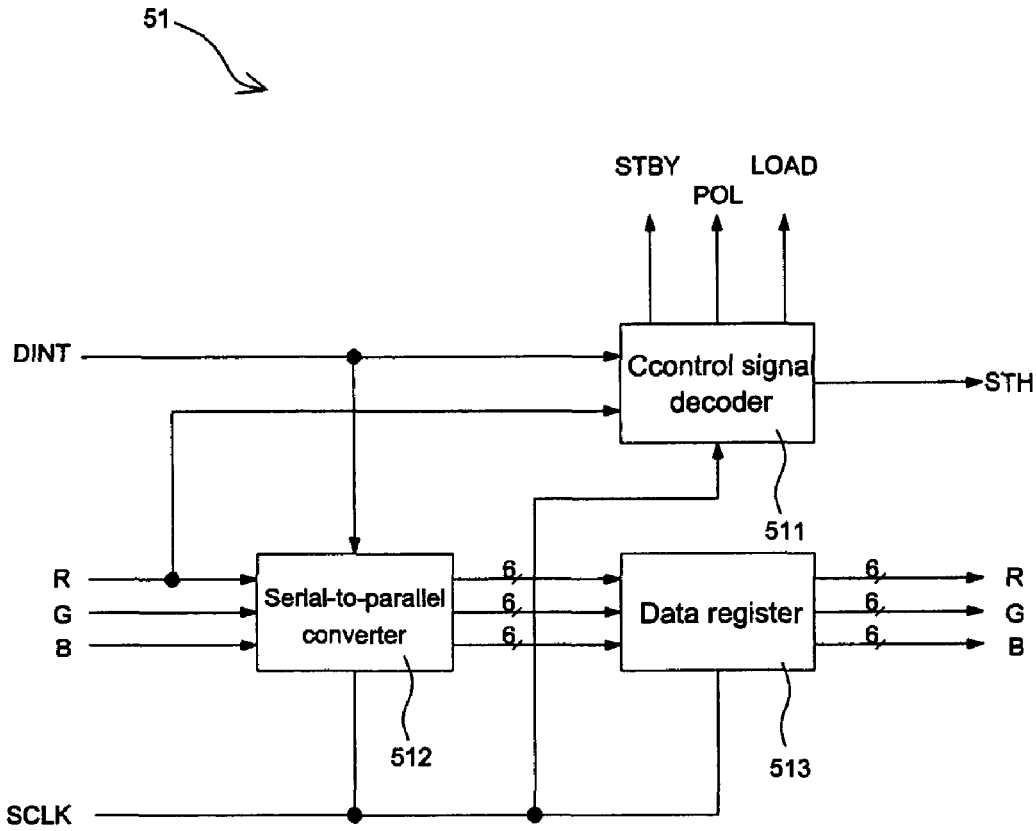
FIG. 6 shows a schematic diagram illustrating the architecture of the control signal decoder/data register shown in FIG. 5.

FIG. 6 shows a schematic diagram illustrating the architecture of the control signal decoder/data register 51 shown in FIG. 5. Referring to FIG. 6, the control signal decoder/data register 51 includes a control signal decoder 511, a serial-to-parallel converter 512, and a data register 513. The control signal decoder 511 receives the mode control signal DINT and data line R and generates a required shift control signal STH, load control signal LOAD, polarity control signal POL, and standby control signal STBY according to the data in the data line R when the mode control signal DINT indicates a command mode. The serial-to-parallel converter 512 receives the mode control signal DINT and data lines R, G, and B, converts the serial data into parallel data, and then stores the parallel data in the data register 513. The serial-to-parallel converter 512 adopts the clock signal SCLK as a sampling clock to sample signals in the data lines R, G, and B, and then the sampled signal are transmitted to the data register 513 by means of data bus. The technique about how the data stored in the data register 513 are transmitted to the shift register 52 and the data latch 53 is well known in the art, thus not explaining in detail.

Figure 7A:
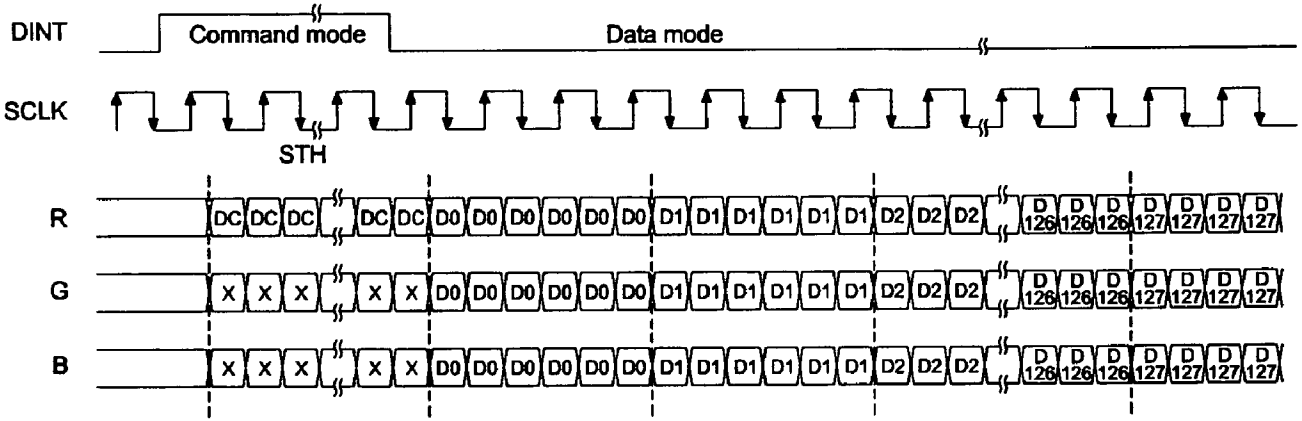
FIGS. 7A and 7B shows schematic diagrams illustrating the data transmission of column data.
Figure 7B:
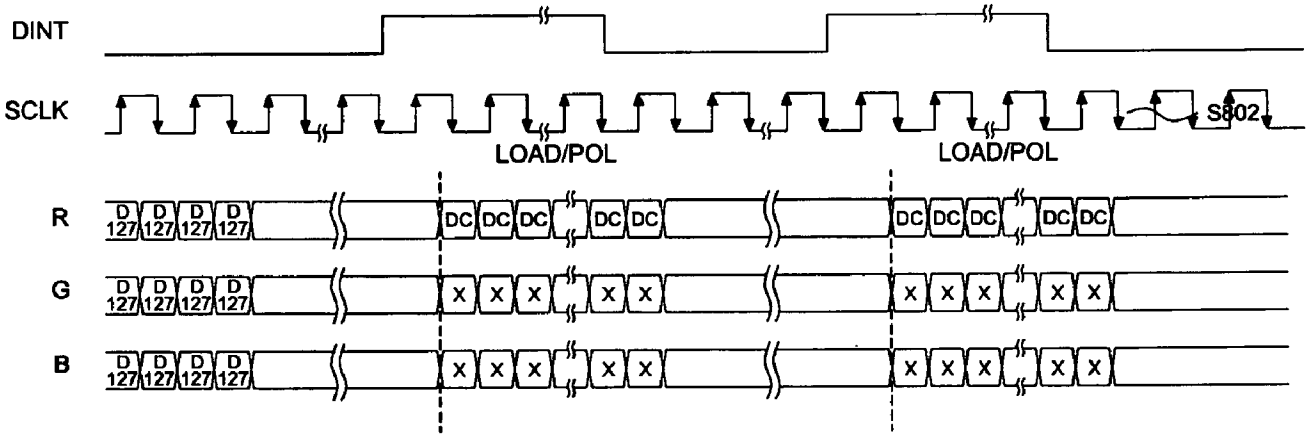

FIGS. 7A and 7B shows schematic diagrams illustrating the data transmission of the column data. When the timing controller 21 transmits control commands to the source driver, the state of the mode control signal DINT is set as a command mode (such as a high level). Meanwhile, the control commands (such as shit control signals STH) are encoded and then transmitted to each of the source drivers via the parallel-to-serial converter 343. Then, the state of the mode control signal DINT is set as the data mode (such as a low level), and the pixel data are sequentially transmitted to their corresponding source drivers. Hence, under the command mode, data R0-R9 may be identical or not so that they are easy to be separately controlled. However, under the data mode, data R0-R9 are the parallel data to be transmitted to each of the source drivers. When the transmission of the serial data ends, the mode control signal DINT is set as a command mode at a proper time according to the electric characteristic of the source driver, and the control commands (such as control signals LOAD and POL) are encoded by the control signal encoder 344 and then transmitted to each of the source drivers via the parallel-to-serial converter 343 to complete the column data transmission. Besides, under the command mode, the data lines used for data transmission include, but are not limited to, data lines R0-R9, and the selection of the data lines depends on the protocol agreed by both sides. Also, the transmitted control signals shown in FIG. 7A are different to those shown in FIG. 7B. Further, though the data shown in FIGS. 7A and 7B are 6-bit, they may be 8-bit or other bit number that is chosen according to panel resolution.

Besides, if the rising edge and the falling edge are both used to sample the transmitted serial data, as shown in FIGS. 7A and 7B, the frequency of the system clock SCLK is reduced to half of that of a conventional system clock. Hence, compared to a conventional system where RSDS architecture is applied, the power consumption is considerably decreased as a result of the reduced frequency. Further, for the same reason, a high transmission speed and performance can be provided to overcome the bottleneck of high-speed transmission in a high-resolution image.

Figure 8:
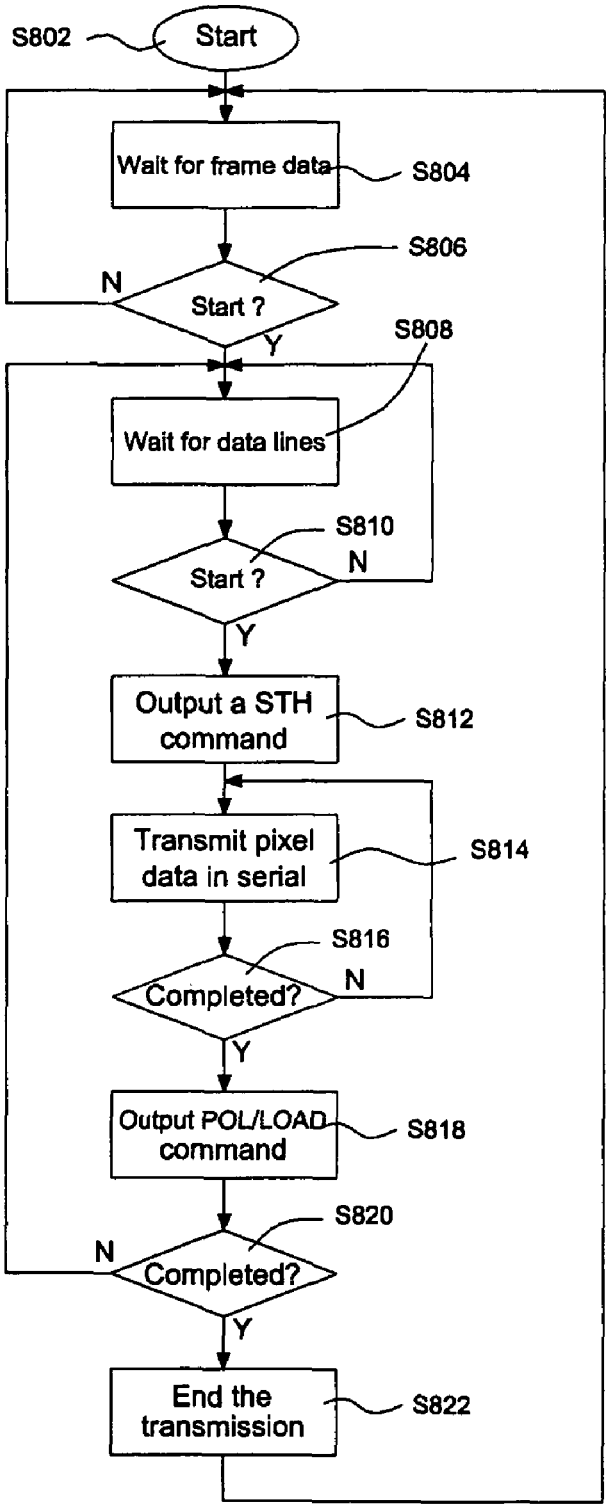
FIG. 8 shows a flow chart illustrating a data control method for an LCD panel according to the invention.

FIG. 8 shows a flow chart illustrating a data control method for an LCD panel according to the invention, where pixel data are transmitted in serial from a timing controller to a source driver chips. The data control method includes the steps as described below.

Step S802: Start.

Step S804: Wait for frame data. The timing controller is under the condition of waiting for the frame data.

Step S806: Judge whether to start the transmission of the frame data. If no, go back to step S804; if yes, go to the next step S808.

Step S808: Wait for data lines. The system is under the condition of waiting for the data lines.

Step S810: Judge whether to start the transmission of the data lines. If no, go back to step S808; if yes, go to the next step S812.

Step S812: Output a STH command. The timing controller outputs the STH command to each of the source driver chips. The STH command is previously converted into serial signals and then transmitted in serial.

Step S814: Transmit pixel data in serial. The timing controller converts the pixel data into serial signals and transmits them to each of the source driver chips in serial.

Step S816: Judge whether the transmission of the data line is completed. If no, go back to step S814; if yes, go to the next step S818.

Step S818: Output a POL/LOAD command. The timing controller outputs the POL/LOAD command to each of the source driver chips. The POL/LOAD command is previously converted into serial signals and then transmitted in serial.

Step S820: Judge whether the transmission of the frame data is completed. If no, go back to step S808; if yes, go to the next step S822.

Step S822: End the transmission of the frame data, and go to step S804.

Through the design of the invention, the timing controller converts the pixel data and the control commands into serial signals, and then they are transmitted in serial to each of the source driver chips. Since all data are previously converted into serial signals, the communication between the timing controller and each source driver chip is achieved by only three R, G, and B data lines, a system clock SCLK, and a mode control signal DINT.

While the invention has been described by way of examples and in terms of the preferred embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A timing controller for an LCD panel, the timing controller receiving transmitted signals including control signals and pixel data and converting the control signals and the pixel data into serial signals that are transmitted to N source drivers, the timing controller comprising:

a signal receiver for receiving the transmitted signals;

a data reader, coupled to the signal receiver for acquiring data from the signal receiver;

a logic control unit, coupled to the data reader for receiving the data acquired by the data reader to generate the pixel data;

a data conversion unit, coupled to the logic control unit for receiving the pixel data, converting the pixel data into serial signals, and outputting the serial signals, wherein the data conversion unit comprises:

a memory having a first memory segment and a second memory segment;

a first multiplexer for receiving the pixel data and transmitting the pixel data to the first memory segment or the second memory segment according to a first selection signal;

a buffer having a first buffer section and a second buffer section;

a second multiplexer for receiving the pixel data from the memory and selectively transmitting the pixel data to the first buffer section or the second buffer section according to the first selection signal and a second selection signal;

a demultiplexer for receiving the pixel data from the buffer and selectively outputting the pixel data in the first buffer section or the second buffer section according to the second selection signal; and a parallel-to-serial converter for receiving the pixel data from the demultiplexer, converting the pixel data into serial signals, and outputting the serial signals;

a control line, coupled between the data conversion unit and the N source drivers for transmitting a mode control signal; and N channels, wherein the $i^{th}$ channel is independently coupled between the data conversion unit and the $i^{th}$ source driver, and the $i^{th}$ channel receives the $i^{th}$ serial signal and transmits to the $i^{th}$ source driver when the mode control signal is in a first state, wherein i is an integer between 1 and N, N is an integer greater than 1.

2. The timing controller as claimed in claim 1, wherein the data conversion unit further comprises a control signal encoder for encoding the control signals to generate encoded signals.

3. The timing controller as claimed in claim 2, wherein the encoded signals are converted into serial signals by the parallel-to-serial converter.

4. The timing controller as claimed in claim 2, wherein the data conversion unit outputs a mode control signal that indicates the transmitted signals are the control signals or the pixel data.

5. The timing controller as claimed in claim 2, wherein the data conversion unit outputs a clock signal used to synchronize output data with the source drivers.

6. The timing controller as claimed in claim 1, each source driver receives receiving serial signals from the timing controller to generate source-drive signals for the LCD panel, each source driver comprising:

a control signal decoder/data register for receiving the serial signals and the mode control signal from a timing controller, selectively decoding control commands or pixel data according to the state of the mode control signal, and outputting a shift control signal, a load control signal, a polarity control signal, a standby control signal and data according to the control commands;

a shift register, coupled to the control signal decoder/data register for receiving the data from the control signal decoder/data register and the shift control signal and executing shift operations according to the shift control signal;

a data latch, coupled to the shift register and the control signal decoder/data register for receiving the data from the shift register and the load control signal and loading received data according to the load control signal;

a digital-to-analog converter, coupled to the data latch and the control signal decoder/data register for receiving the data from the data latch and the polarity control signal, the polarity control signal being used to control the digital-to-analog converter; and an output buffer, coupled to the digital-to-analog converter and the control signal decoder/data register for receiving the data from the digital-to-analog converter and the standby control signal and outputting data according to the standby control signal.

7. The timing controller as claimed in claim 6, wherein the control signal decoder/data register includes:

a control signal encoder for receiving the mode control signal and the serial signals and decoding the serial signals to generate the shift control signal, the load control signal, the polarity control signal, and the standby control signal when the mode control signal is in a first state;

a serial-to-parallel converter for receiving the mode control signal and the serial signals, converting the serial signals into parallel signals when the mode control signal is in a second state, and outputting the parallel signals; and a data register for receiving the parallel signals.

8. The timing controller as claimed in claim 7, wherein the serial-to-parallel converter receives a clock signal used as a reference clock signal.

9. A control circuit for an LCD panel having a timing controller and N source drivers, wherein control signals and a pixel data are transmitted in serial from the timing controller to the source driver when the timing controller receiving transmitted signals, the timing controller comprising:

a signal receiver for receiving the transmitted signals;

a data reader, coupled to the signal receiver for acquiring data from the signal receiver;

a logic control unit, coupled to the data reader for receiving the data acquired by the data reader to generate the pixel data;

a data conversion unit, coupled to the logic control unit for receiving the pixel data, dataconverting the pixel data into serial signals, and outputting the serial signals, wherein the data conversion unit comprises:

a memory having a first memory segment and a second memory segment;

a first multiplexer for receiving the pixel data and transmitting the pixel data to the first memory segment or the second memory segment according to a first selection signal;

a buffer having a first buffer section and a second buffer section;

a second multiplexer for receiving the pixel data from the memory and selectively transmitting the pixel data to the first buffer section or the second buffer section according to the first selection signal and a second selection signal;

a demultiplexer for receiving the pixel data from the buffer and selectively outputting the pixel data in the first buffer section or the second buffer section according to the second selection signal; and a parallel-to-serial converter for receiving the pixel data from the demultiplexer, converting the pixel data into serial signals, and outputting the serial signals;

a control line, coupled between the data conversion unit and the N source drivers for transmitting a mode control signal; and N channels, wherein the $i^{th}$ channel is independently coupled between the data conversion unit and the $i^{th}$ source driver, and the $i^{th}$ channel receives the $i^{th}$ serial signal and transmits to the $i^{th}$ source driver when the mode control signal is in a first state, wherein is an integer between 1 and N, N is an integer greater than 1.

10. The control circuit as claimed in claim 9, wherein the timing controller is connected with each said source driver by a plurality of signal lines, and the serial signals are transmitted via the signal lines.

11. The control circuit as claimed in claim 10, wherein the control commands are converted into serial signals by the timing controller and further transmitted via at least one of the signal lines.

12. The control circuit as claimed in claim 10, wherein the timing controller outputs a the mode control signal to each said source driver, and the mode control signal indicates the transmitted serial signals are the control signals or the pixel data.

* * * * *